US008020568B2

(12) United States Patent
Pyo et al.

(10) Patent No.: US 8,020,568 B2
(45) Date of Patent: Sep. 20, 2011

(54) DISHWASHER

(75) Inventors: Joon Ho Pyo, Seoul (KR); Tae Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/876,427

(22) Filed: Sep. 7, 2010

(65) Prior Publication Data

US 2010/0326478 A1 Dec. 30, 2010

Related U.S. Application Data

(62) Division of application No. 11/902,960, filed on Sep. 26, 2007, now Pat. No. 7,810,512.

(30) Foreign Application Priority Data

Mar. 31, 2007 (KR) ..... 10-2007-0032119

(51) Int. Cl.
*B08B 3/00* (2006.01)

(52) U.S. Cl. ..... 134/103.2

(58) Field of Classification Search ..... 134/103.2
See application file for complete search history.

(56) References Cited

U.S. PATENT DOCUMENTS

| | | | | |
|---|---|---|---|---|
| 5,423,485 | A | 6/1995 | Tagusari | |
| 5,496,417 | A | 3/1996 | Farrugia et al. | |
| 6,422,180 | B1 | 7/2002 | Yiu | |
| 2002/0178932 | A1 * | 12/2002 | Cai | 99/516 |
| 2004/0187898 | A1 | 9/2004 | Chen | |
| 2004/0195398 | A1 | 10/2004 | Mukai et al. | |

FOREIGN PATENT DOCUMENTS

| | | |
|---|---|---|
| EP | 1738677 | 1/2007 |
| WO | WO 2006/129928 A2 | 12/2006 |

* cited by examiner

*Primary Examiner* — Michael Barr
*Assistant Examiner* — David Cormier
(74) *Attorney, Agent, or Firm* — McKenna Long & Aldridge LLP

(57) ABSTRACT

The present invention relates to a dishwasher. A dishwasher includes a washing tub in which dishes are placed, a steam generator that generates steam and a nozzle part in which a flow direction of the steam is diverted at least one time to allow the steam exhausted to the washing tub.

6 Claims, 8 Drawing Sheets

DISHWASHER

CROSS REFERENCE TO RELATED APPLICATION

This application claims the benefit of, and is a divisional of, U.S. patent application Ser. No. 11/902,960, filed Sep. 26, 2007 (now U.S. Pat. No. 7,810,512, issued Oct. 12, 2010), and claims the benefit of Korean Patent Application No. 10-2007-0032119, filed on Mar. 31, 2007, each of which is hereby incorporated by reference as if fully set forth herein.

BACKGROUND

1. Field of the Disclosure

The present disclosure relates to home appliances, such as a dishwasher.

2. Discussion of the Related Art

Dishwashers typically have washing tubs and washing water is sprayed at a high pressure. The sprayed water reaches dishes to wash out foreign substances such as food scraps remaining on the dishes. The food scraps are then filtered out and the washing water is recycled. Detergent dissolves in the washing water to facilitate the removal of food scraps from the dishes.

More recently, a new technology has been developed where washing water is heated so that detergent more easily dissolves in the washing water to improve dishwashing efficiency as compared to conventional dishwashers.

However, the above technology is limited to improve dishwashing efficiency. Certain foods tend to adhere to dishes and cooking vessels more so than other foods. For instance, rice is often difficult to wash off dishes, which makes dishwashing efficiency more important. This problem is not solved, even if a soaking course for food scraps is performed using hot washing water. In addition, performing a soaking course adds significant time to the overall dishwashing process.

SUMMARY OF THE DISCLOSURE

Accordingly, a dishwasher that can remove food scraps adhering to dishes and other cooking vessels in a more efficient and effective manner is highly desirable.

Various advantage and features will be set forth in part in the description which follows and in part will become apparent to those having ordinary skill in the art upon examination of the following or may be learned from practice of the invention. The aforementioned advantages and features may be realized and attained by the structure and/or methods pointed out in the written description, claims, and appended drawings.

As embodied and broadly described herein, a dishwasher may include a washing tub in which dishes are placed; a steam generator that generates steam; and a nozzle part in which a flow direction of the steam is diverted at least one time to allow the steam exhausted to the washing tub.

Alternatively, a dishwasher may include a washing tub in which dishes are placed; a steam generator that generates steam; and a nozzle part that comprises an inlet hole and a outlet hole to exhaust the steam inside the washing tub, wherein a predetermined filtering chamber is formed inside the nozzle part to prevent foreign substances drawn through the outlet hole from being drawn through the inlet hole.

It is to be understood that both the foregoing general description and the following detailed description of the disclosure by way of examples and thus do not limit the scope of claims.

BRIEF DESCRIPTION OF THE DRAWINGS

The accompanying drawings, which are included to provide a further understanding of the disclosure and are incorporated in and constitute a part of this application. In the drawings.

DESCRIPTION OF SPECIFIC EMBODIMENTS

Reference will now be made in detail to several exemplary embodiments, which are also illustrated in the accompanying drawings. Wherever possible, the same reference numbers will be used throughout the drawings to refer to the same or like parts.

Figure 1:
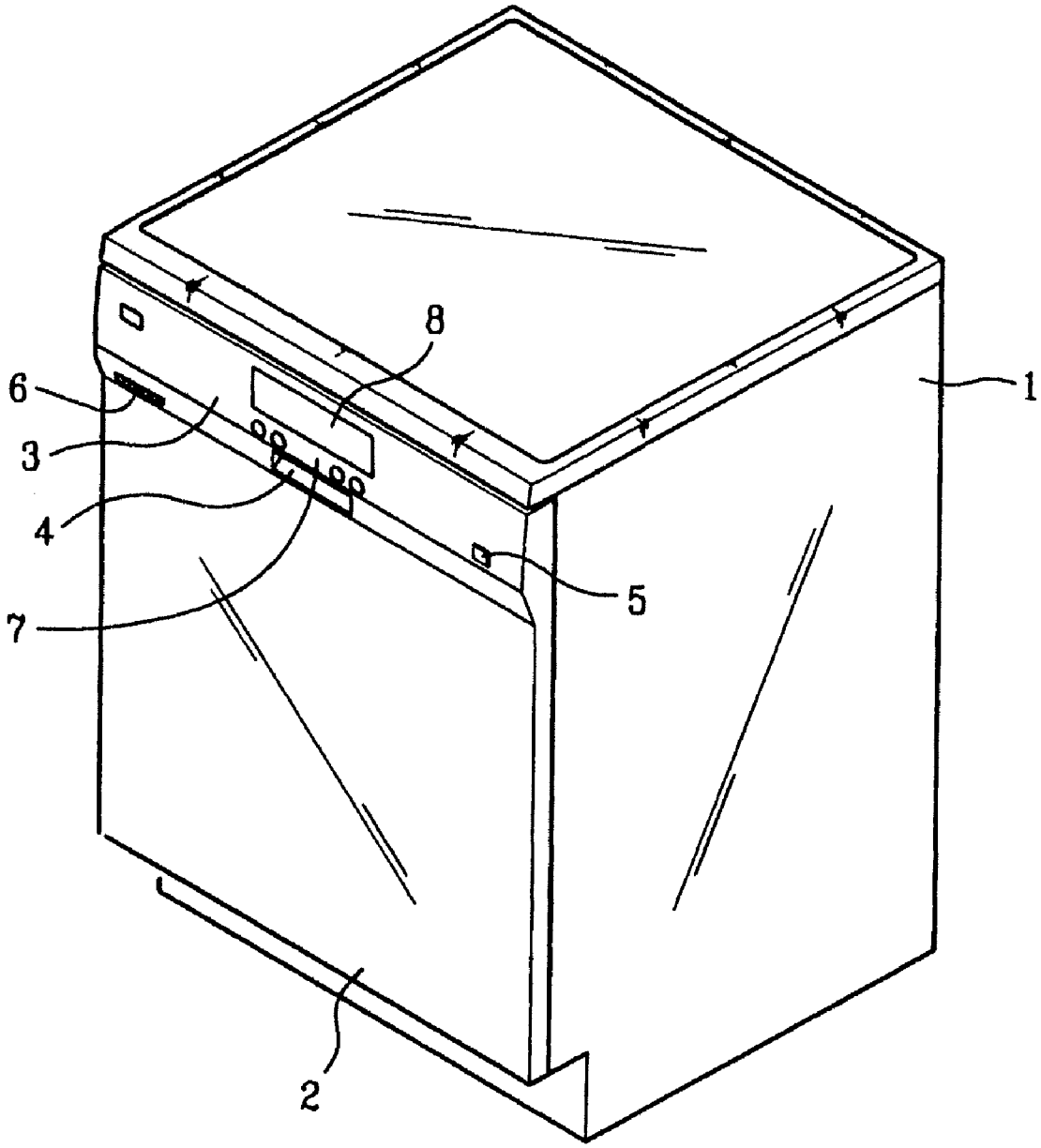
FIG. 1 is a perspective view illustrating an exemplary dishwasher.
Figure 2:
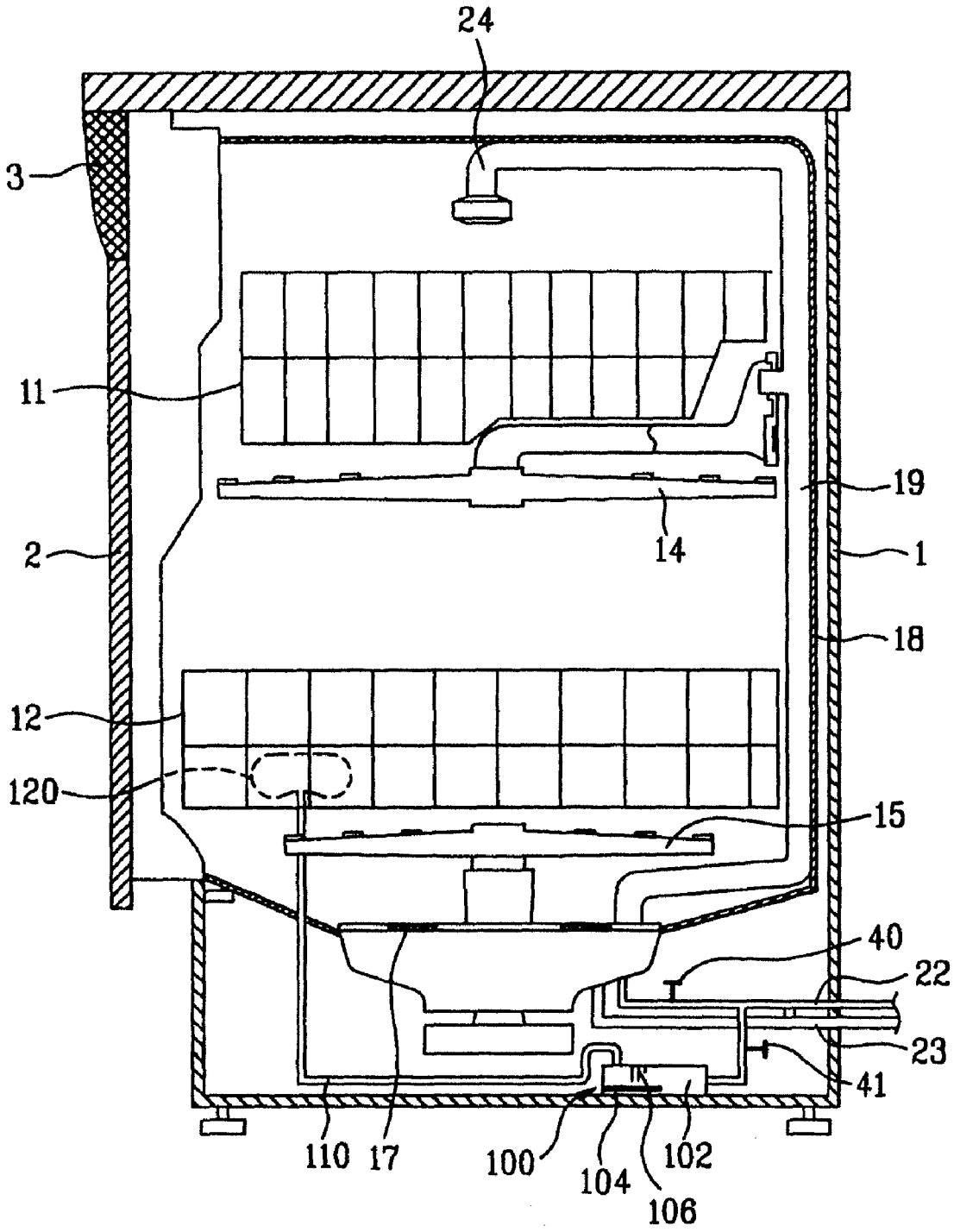
FIG. 2 is a longitudinally sectional view illustrating the dishwasher shown in FIG. 1.

FIGS. 1 and 2 illustrate an exemplary dishwasher.

With reference to FIG. 1, the dishwasher includes a case 1, a door 2 and a control panel 3. The case 1 generally defines three exterior sides of the dishwasher, where the door 2 generally defines the fourth or front exterior side of the dishwasher. The door 2 opens and closes to access the inside of the dishwasher. When fully closed, case 1 is airtight.

The control panel 3 is provided on an upper portion of the door 2. It is used to display the status of and control the operation of the dishwasher. Specifically, the control panel 3 may include a power button 5, a door handle 5, a function operation part 7, a display 8 and a steam outlet 6. The power button 5 is used to turn on/off the power of the dishwasher. A user uses the door handle 4 when opening and closing the door 2. The user selects predetermined dishwasher operations using the function operation part 7. The display 8 displays the operational status or condition of the dishwasher. High temperature air inside the dishwasher is exhausted through the steam outlet 6.

FIG. 2 illustrates a longitudinal section of FIG. 1. As shown, a washing tub 18 is mounted in the dishwasher to store washing water and a sump 16 is provided in a lower portion of the washing tub 18 to collect washing water. After collecting washing water, the sump 16 filters foreign substances and sprays the water back into the washing tub 18. A filter 17 is provided in a lower portion of the washing tub 18 to filter the aforementioned foreign substances from the washing water as the washing water is collected by the sump 16. A washing water conduit 19 may be provided at a predetermined inner surface of the washing tub 18 to supply washing water to the upper nozzle 14.

In addition, a number of racks, for example, racks 11 and 12 are provided in the washing tub 18. Racks 11 and 12 may be separated vertically. Further, a number of nozzles, for example, nozzles 14, 15 and 24 are positioned inside the washing tub 18 to spray water toward the racks 11 and 12, respectively.

The dishwasher includes a steam generator 100. The steam generator 100 may be provided at the bottom of the washing tub 18 to generate steam. A steam conduit 110 may be positioned as shown, through which steam is supplied to the washing tub 18. The dishwasher further includes water supply and water drain tubes. A water supply tube 22 connects the washing tub 18 to an outside water source. Water is therefore supplied to the washing tub 18 through the water supply tube 22. A water drain tube 23 is used to drain water from washing tub 18. The water supply tube 22 may be bifurcated as shown. A washing tub valve 40 and a steam valve 41 are provided to open and close respective portions of the water supply tube 22. As a result, the amount of water passing through each portion of the water supply tub 22 may be independently controlled. The washing tub valve 40 is used to control the amount of water supplied to the washing tub 18 and the steam valve 41 is used to control the amount of water supplied to the steam generator 100.

The operation of the dishwasher described above will now be explained. After the user places dishes and other items on the racks 11 and 12 and closes the door 2, the user selects the desired settings and/or conditions using the function operation part 7 and starts the dishwasher. The operational state of dishwasher is displayed on the display 8.

The water flow will now be explained. After washing water sprays through the nozzles 14, 15 and 24 and onto the dishes on the racks 11 and 12, the water drops downward and then flows into the sump 16. A predetermined pump such as an impeller is mounted inside the sump 16 and the water is resupplied to the nozzles 14, 15 and 24. As the water flows into the sump 16, food scraps are filtered by the filter 17 to clean the washing water and to prevent the nozzles from being clogged.

In addition, the dishwasher may employ a dishwashing process that uses steam. To perform the dishwashing process using steam, the steam generator 100 supplies steam to the washing tub 18. As a result, the operational reliability of the dishwasher and its efficiency are significantly improved.

To generate the steam, the steam generator 100 includes a water tank 102, a heater 104, a water level sensor 106 and a fuse (not shown). The water tank 102 stores water therein. The heater 104 heats the water stored in the water tank 102. The water level sensor 106 senses the water level inside the water tank 102. The fuse (not shown) prevents the heater 104 from overheating.

The steam conduit 110 is connected to a portion of the water tank 102. It extends from the water tank 102 to the washing tub 18 to guide the steam to the washing tub 18. A nozzle part 120 may be provided at the end of the steam conduit 110 to allow the steam to be sprayed inside the washing tub 18.

Figure 3A:
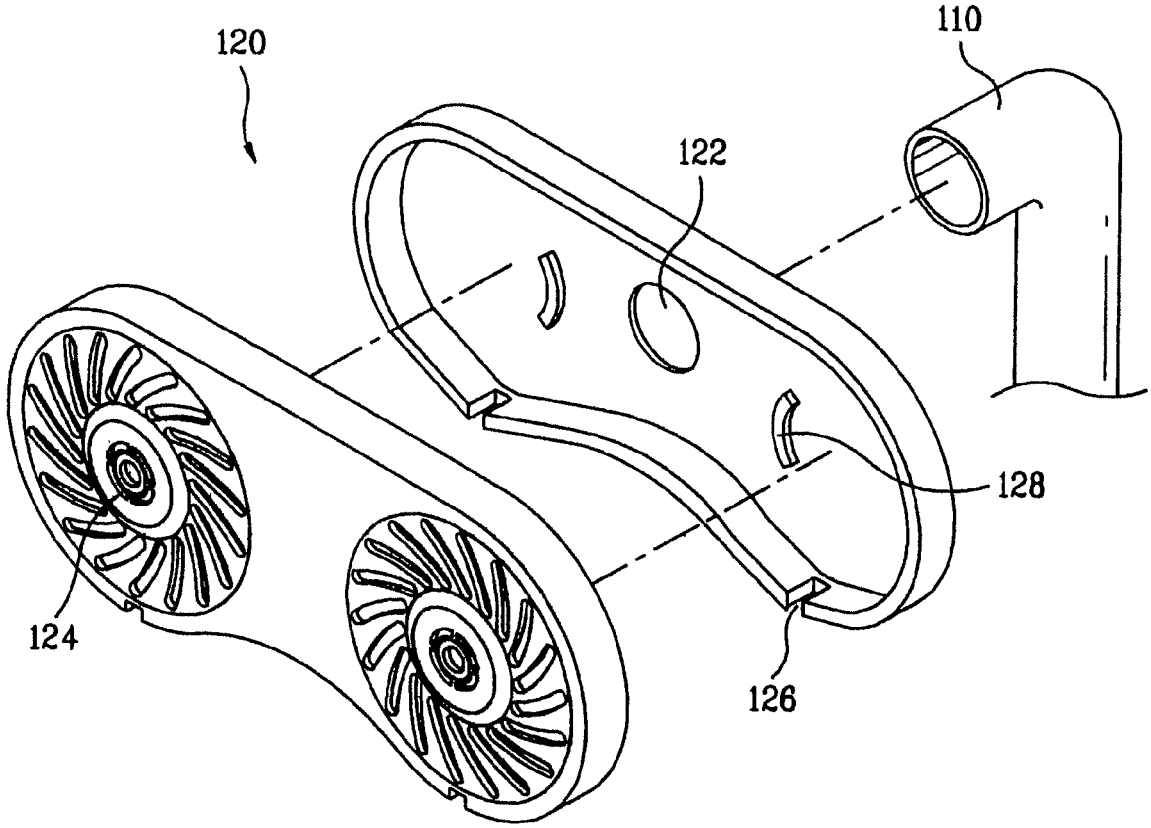
FIG. 3A is an exploded perspective view illustrating a nozzle part according to a first exemplary embodiment.
Figure 3B:
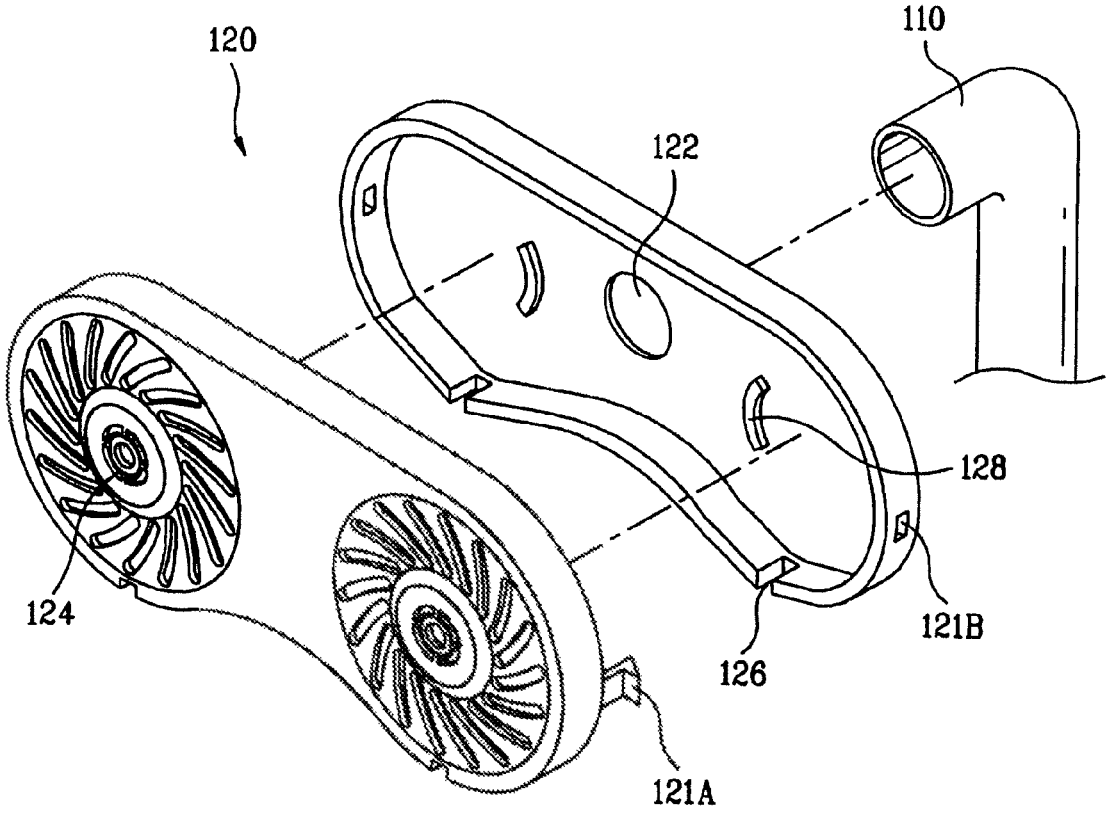
FIG. 3B is an exploded perspective view illustrating an exemplary connection in a nozzle part according to the disclosure.

FIGS. 3A and 3B illustrate the nozzle part 120. As shown, the nozzle part 120 includes an inlet hole 122 and outlet hole 124. It is noted that more than one outlet hole 124 may be provided in various arrays of patterns, as seen in FIGS. 3A and 3B. The inlet hole 122 is positioned to coincide with the steam conduit 110. Thus, steam is drawn through the inlet hole 122. The outlet hole 124 are positioned on the surface of the nozzle part 120 that faces toward the inside of the washing tub 18 so that the steam can be sprayed through the outlet hole 124 and into the tub 18.

If the steam is sprayed inside the washing tub 18, foreign substances and food scraps adhering to the dishes are soaked by the steam. The steam makes dishwashing more efficient and effective. However, foreign substances including dirt and food scraps that come off the dishes might be drawn into the nozzle part 120 through the outlet hole 124. In addition, if foreign substances are drawn into the nozzle body 120 they might further be drawn into the steam conduit 110 and/or the steam generator 100. Foreign substances that get stuck in the steam conduit 110 and/or steam generator 100 would be difficult to remove. Because the foreign substances are mostly food scraps, the foreign substances may spoil within the steam conduit 110, due to high temperatures and high humidity, causing odors and other problems.

Thus, it is desirable to employ a structure that prevents foreign substances from being drawn into the steam conduit 110 or to expel any foreign substances that did get inside.

Exemplary embodiments of the nozzle body 120 will now be explained, wherein the nozzle body 120 will prevent foreign substances from being drawn into the outlet hole 124 and, therefore, from being drawn into the steam conduit 110 or the already drawn-in foreign substances from being expelled.

Referring now to FIGS. 3A-5, the nozzle body 120 according to an exemplary embodiment includes the inlet hole 122 and the outlet hole 124. The inlet hole 122 coincides with the steam conduit 110. The outlet hole 124 are formed at the surface of the nozzle body 120 that faces toward the inside of the washing tub 18 so that steam can be sprayed into the tub 18. In addition, the inlet hole 122 is positioned on a surface of the nozzle body 120 that is opposite the surface facing towards the inside of the washing tub 18.

Here, a flow direction of the steam is redirected at least one time inside the nozzle part 120 before the steam is sprayed into the washing tub 18 through the outlet hole 124. In order to redirect the flow direction of steam, the outlet hole 124 are positioned such that they do not line up directly across from the inlet hole 122. As shown, for example, in FIGS. 4 and 5, the outlet hole 124 are spaced apart a predetermined distance (d) from the inlet hole 122 which, as stated, coincides with the steam conduit 110. Accordingly, the steam conduit 110 and the outlet hole 124 are not aligned. This prevents the foreign substances from being directly drawn into the steam conduit 110.

As a result, even if foreign substances are drawn through the outlet hole 124 during dishwashing, the foreign substances may not be directly drawn through the inlet hole 122. Instead and they may contact an inner surface of the nozzle part 120 first. As a result, the foreign substances would remain inside the nozzle part 120. Thus, the space inside the nozzle part 120 is used as a filtering chamber 129 that prevents foreign substances drawn inside the nozzle part 120 from passing through inlet hole 122 and, ultimately, the steam conduit 110 or the steam generator 100.

In addition, the filtering chamber 129 may serve as a space in which water condensed from the steam is collected. Accordingly, some of the steam drawn inside the nozzle part 120 through the steam conduit 110 passes into the filtering chamber 129 and condenses into water while the rest of the steam sprays into the washing tub 18. The condensed water may collect in a lower portion of the filtering chamber 129. As a result, the amount of condensed water generated during the process of supplying steam to the washing tub 18 may be reduced and, in turn, the amount of steam supplied to the washing tub, relative to the amount of water, may be increased, which enhances the efficiency of dishwashing. Specifically, while steam supplied by the steam generator 100 passes through the steam conduit 110 and the filtering chamber 129 to be exhausted into the washing tub 18, the condensed water flows back through the seam conduit 110. Hence, the continuously supplied steam may be condensed into water by the condensed water more easily.

As mentioned above, the filtering chamber 129 according to this embodiment may take the form of a space, wherein the flow of steam is redirected at least one time. It may also take the form of a space wherein foreign substances drawn into the nozzle part 120 collect. Finally, it may take the form of a space wherein water condensed from the steam is collected.

Although not shown in the drawings, the outlet hole 124 may be positioned perpendicularly with respect to the inlet hole 122.

In addition, a foreign substance outlet hole 126 may be formed at the nozzle part 120, wherein foreign substances drawn through the outlet hole 124 can be expelled from the nozzle part 120 through the foreign substance outlet hole 126. The foreign substance outlet hole 126 may be positioned below the outlet hole 124 of the nozzle part 120.

Foreign substances drawn inside the nozzle part 120 through the outlet hole 124 are expelled into the washing tub 18 through the foreign substance outlet hole 126. This prevents foreign substances from being drawn into the steam conduit 110. It also prevents foreign substances from rotting inside the nozzle part 120. In addition, water collected in the filtering chamber 129 may be expelled into the washing tub 18 through the foreign substance outlet hole 126.

As shown in the figures, the bottom surface of the nozzle part 120 may be shaped (e.g., such that the surface curved) oblique with respect to the foreign substance outlet hole 126. This shape allows foreign substances and/or condensed water to be directed toward and, therefore, more effectively expelled through the foreign substance outlet hole 126.

As illustrated in FIG. 3B a means for connecting a front and back portion of nozzle 120 may be provided. It is possible that foreign substances may enter nozzle 120 and become unable to exit via foreign substance exit hole 126 due to size or other conditions. Thus they may be trapped inside filtering chamber 129 and left to spoil or obstruct steam spraying from nozzle 120. In such an instance the user may be given the option of manually opening nozzle 120 to remove the foreign substances. Fastening tab 121A and mating notch 121B may be provided to enable a user to disconnect and reconnect a front portion of nozzle 120 to a rear portion of nozzle 120. One of skill in the art will appreciate that various fastening systems and structures may be employed, such as a hinged or other connection, in order to create accessibility to the interior of chamber 129 without departing from the scope or spirit of the disclosure.

A foreign substance prevention partition 128 may be provided inside the nozzle part 120 to prevent foreign substances from being drawn into the steam conduit 110 through the inlet hole 122. The foreign substance prevention partition 128 may be positioned between the inlet hole 122 and the outlet hole 124 inside the nozzle part 120.

If the foreign substance prevention partition 128 completely partitioned off the space inside the nozzle part 120 between the inlet hole 122 and the outlet hole 124, the steam may not be efficiently and effectively exhausted. Thus, the foreign substance prevention partition 128 partitions a predetermined portion between the inlet hole 122 and the outlet hole 124 to prevent foreign substances from being drawn into the steam conduit 110. Additionally, the foreign substance prevention partition 128 may be oblique with respect to the steam flow direction so it does not interfere with the steam flow.

One of skill in the art will appreciate that all of the structures, i.e. the outlet hole 124, the steam conduit 110, the foreign substance outlet hole 126, or the foreign substance prevention partition 128 may be utilized in the nozzle part 120. Alternatively, it will be appreciated that one or more of the above structures may be utilized in combination, in the nozzle part 120 in order to satisfy design and/or manufacturing constraints, without departing from the scope or spirit of the disclosure.

In the exemplary embodiment illustrated in FIGS. 3A and 3B, a foreign substance outlet hole 126 and a foreign substance prevention partition 128 are provided. Here, the foreign substance prevention partition 128 may be used to guide foreign substances toward the foreign substance outlet hole 126 as well as to prevent foreign substances from being drawn into the steam conduit 110.

Figure 5:
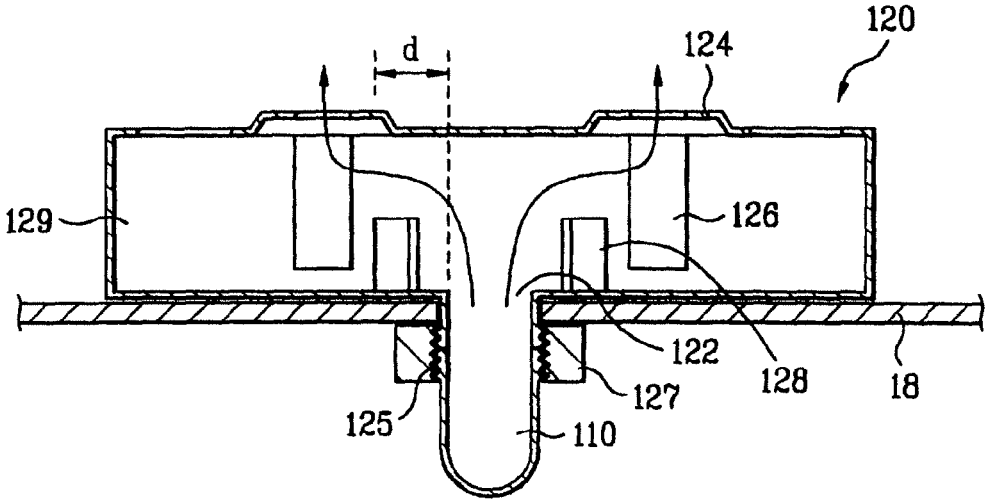
FIG. 5 is a sectional view along line I-I' as shown in FIG. 4.

As illustrated in FIG. 5, the nozzle part 120, and in particular, that portion of the nozzle part 120 that contains the outlet hole 124 may project into the washing tub 18. In so doing, the outlet hole 124 is positioned in close proximity to the dishes. This allows the steam to more effectively soak the dishes when it is exhausted from the nozzle part 120.

In contrast, the surface of the nozzle part 120 which contains the inlet hole 122 may be positioned such that it contacts the washing tub 18, or is positioned relatively close to the wall of the wash tub 18. If the nozzle part 120 is spaced apart from the washing tub 18, foreign substances generated during the dishwashing process might get stuck between the nozzle part 120 and the washing tub 18, and this might cause foreign substances to get stuck between nozzle part 120 and the all of washing tub 18.

A fastening method of the nozzle part 120 is now described herein below. Referring, for example, to FIG. 5, the structure that forms the inlet hole 122 of the nozzle part 120 may extend outward a predetermined distance from the nozzle part 120. A screw thread 125 may be formed on an outer circumferential surface of the extended portion as shown. In addition, a screw thread 125 may be formed on an outer surface of the steam conduit 110 where the steam conduit 110 meets the inlet hole 122.

In order to secure the nozzle part 120 to the washing tub 18, the structure forming the inlet hole 122 is inserted through an inserting hole 19 formed in the wall of the washing tub 18. The inserting hole 19 is positioned so that it aligns with the steam conduit 110. A nut 127 that is fastened to the end of the steam conduit 110 screws on to the threads associated with the inlet hole structure, thereby fastening the end of the steam conduit 110 to the inlet hole structure of nozzle part 120. When the nut 127 is tightened, the nozzle part 120 is pulled towards the wall of the washing tub 18; thus, the nozzle part 120 may come in to close contact with the washing tub 18.

Although not shown in the drawings, a sealing member may be provided on the surface of the nozzle part 120 that faces the washing tub 18. The main purpose of the sealing member is to prevent foreign substances from getting stuck between the nozzle part 120 and the washing tub 18.

Figure 4:
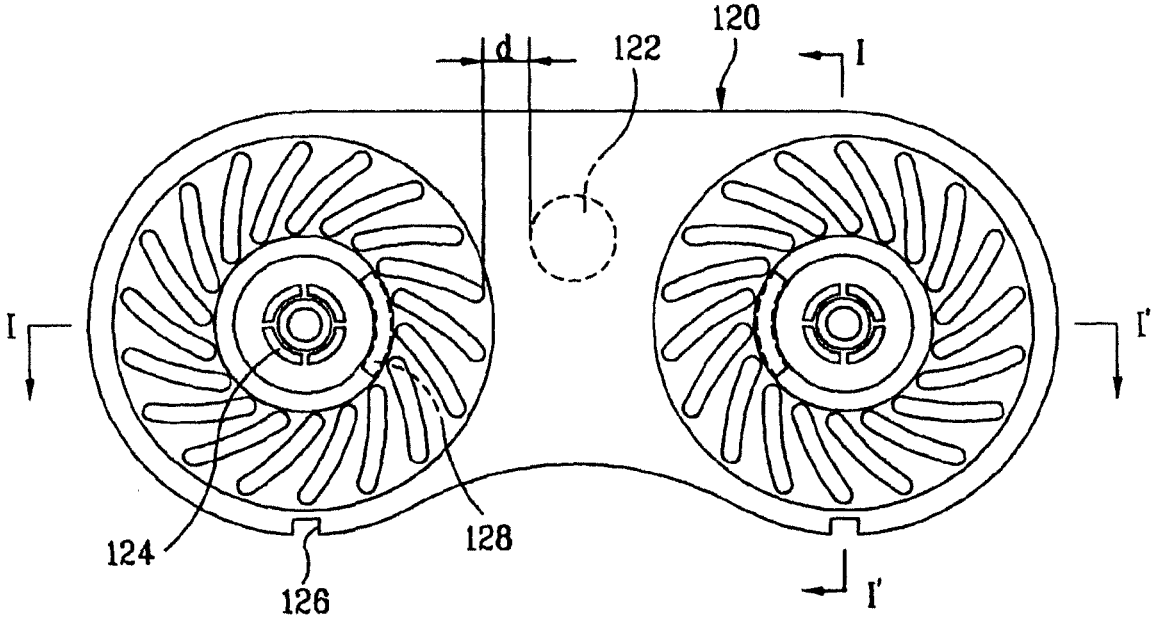
FIG. 4 is a front view of the nozzle part shown in FIG. 3.

According to the exemplary embodiment generally illustrated in FIGS. 3-5, the outlet hole 124 is positioned on surface of the nozzle part 120 that faces the inside of the washing tub 18, whereas the inlet hole 122 is positioned on a surface of the nozzle part 120 facing the wall of the washing tub 18. In a second exemplary embodiment, the inlet hole is positioned an alternative location.

Figure 6:
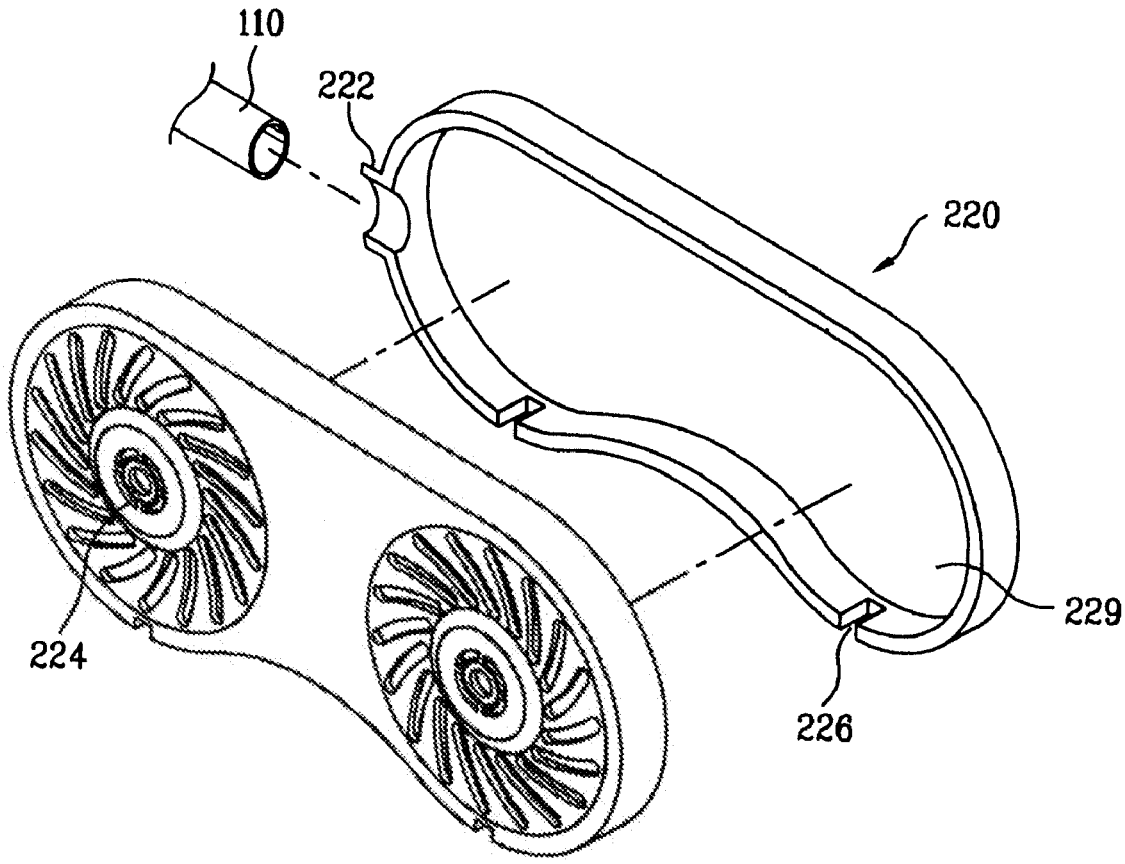
FIG. 6 is an exploded perspective view illustrating a nozzle part according to a second exemplary embodiment.
Figure 7:
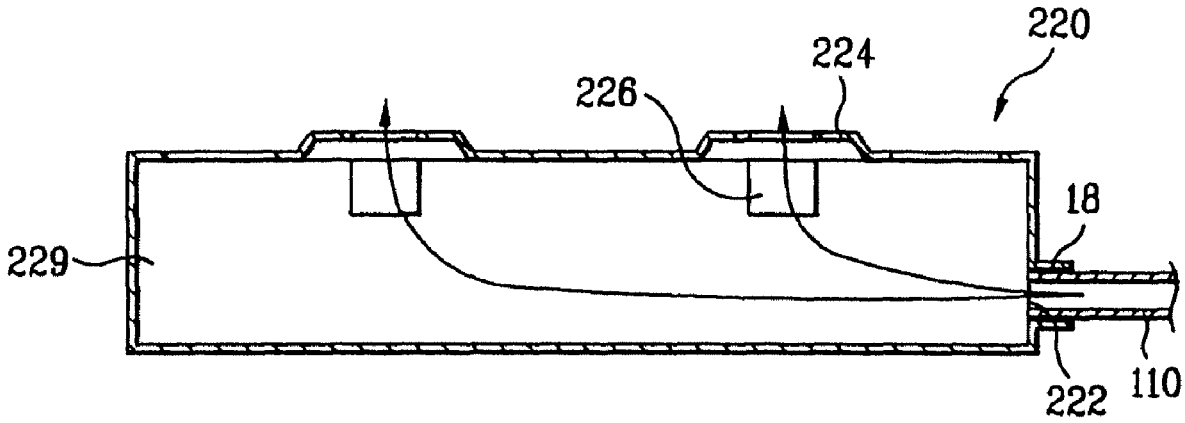
FIG. 7 is a sectional view of FIG. 6.

FIGS. 6 and 7 illustrate a nozzle part 220 according to the second exemplary embodiment of the dishwasher. As shown, the nozzle part 220 according to this embodiment, is similar to the nozzle part 120 illustrated in FIGS. 3-5. Here, the nozzle part 220 includes an inlet hole 222, an outlet hole 224 and a filtering chamber 229. The inlet hole 222 is fastened to the steam conduit 110. Consequently, the steam is drawn through the inlet hole 222 from the steam conduit 110. The steam is exhausted into the washing tub 18 through the outlet hole 224. Inside the filtering chamber 229, the steam flow is redirected at least one time before being exhausted through the outlet hole 224. As in the first exemplary embodiment, the re-direction of the steam facilitates the collection of foreign substances that are drawn through the outlet hole 224.

In a manner that is the same or similar to the first exemplary embodiment, the outlet hole 224 is positioned on a first or front surface of the nozzle part 220 that faces the inside of the washing tub 18. However, inlet hole 222 is formed through a side surface of the nozzle part 220. According, the direction of the steam flowing through the inlet hole 222 is different from the direction of the steam flow through the outlet hole 224. The steam is drawn into the filtering chamber 229 and thus redirected inside the filtering chamber 229 before being exhausted through the outlet hole 224. By positioning inlet hole 222 and the outlet hole 224 so that they do not align with each other, foreign substances drawn through the outlet hole 224, are likely to collide with an inner surface of the nozzle part 220 and remain inside the filtering chamber 229 without being drawn into the steam conduit 110 through the inlet hole 222. As one can readily see from FIGS. 6 and 7, foreign substances drawn through the outlet hole 224, would have to flow perpendicularly against the flow of steam in order to enter the steam conduit 110 through the inlet hole 222.

Also in the same or similar manner as the first exemplary embodiment, a foreign substance outlet hole 226 may be formed through the bottom surface of the nozzle part 220, where the bottom surface of the nozzle part 220 may be oblique with respect to the foreign substance outlet hole 226 to guide the foreign substances and the collected water to the foreign substance outlet hole 226. Although not shown in the drawings, a configuration corresponding to the foreign substance prevention partition 128, (see FIG. 3) may be provided in this second exemplary embodiment.

According to the above embodiments, the auxiliary nozzle part 120 and 220 is provided at the end of the steam conduit 110 to direct steam inside the washing tub 18. In the event that the auxiliary nozzle part 120 and 220 is not used, it is envisioned that the end of the steam conduit 110 may be formed in a nozzle shape to direct or spray the steam inside the washing tub 18.

Figure 8:
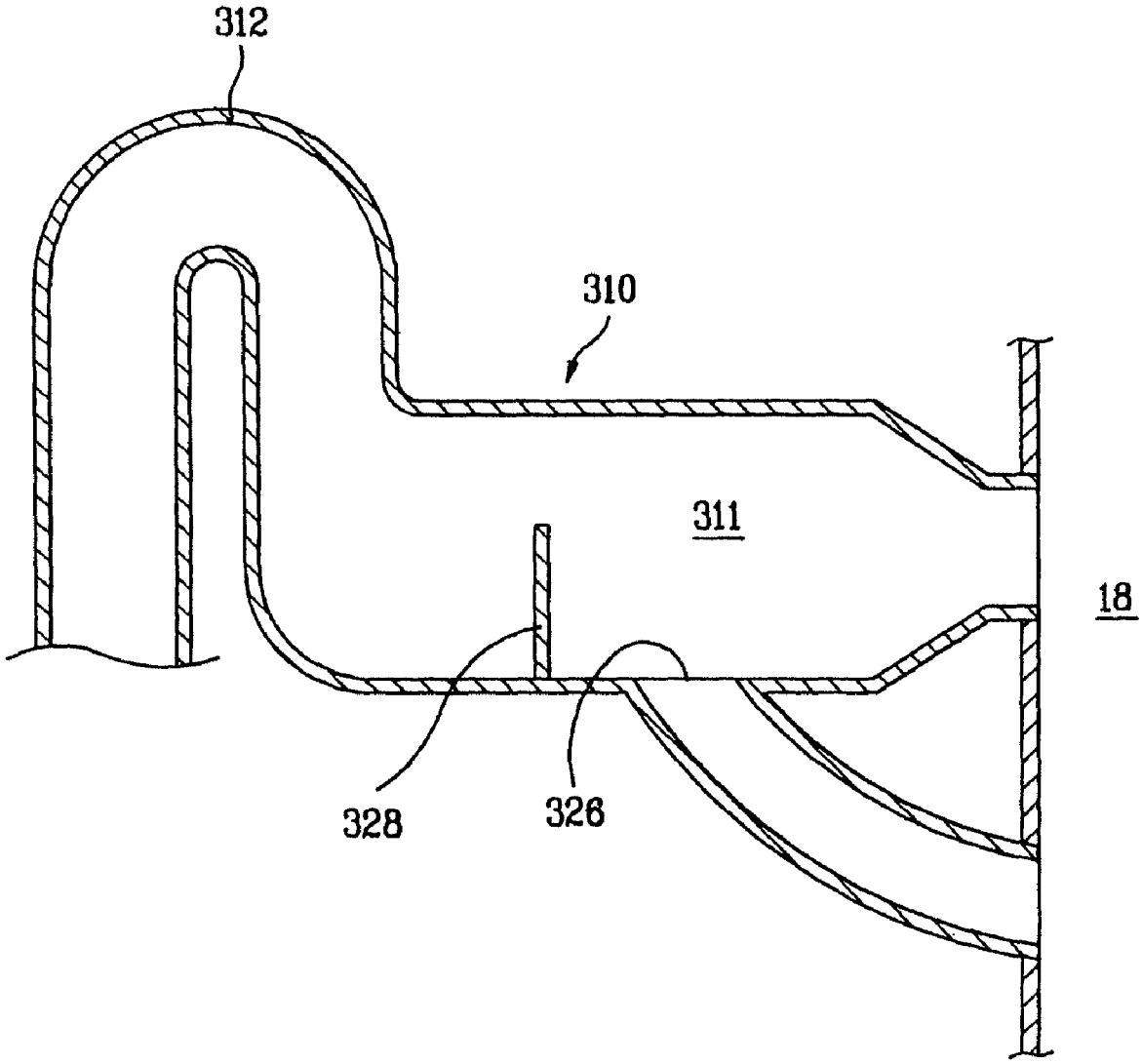
FIG. 8 is an exploded perspective view illustrating a exemplary steam conduit.

Similar to the circumstances described in the above exemplary embodiments, foreign substances that come off the dishes might be drawn into the steam conduit. FIG. 8 illustrates an end of a steam conduit 310 according to a third exemplary embodiment of the dishwasher having a structure that prevents foreign substances from being drawn into the steam generator 100. Steam conduit 310 may be used when steam is supplied to the washing tub by using the steam conduit alone, without the nozzle part 120 and 220.

According to this exemplary embodiment, the end of the steam conduit 310 extends to the washing tub 18 to direct the steam inside the washing tub 18. A predetermined portion near an end of steam conduit 310 may be bent to prevent the foreign substances from being drawn into the steam conduit 310 further. The predetermined bent portion 312 may be formed a predetermined distance from an output end 311 of the steam conduit 310. The output end 311 is located near the washing tub 18. Accordingly, even though foreign substances may be drawn-in through the output end 311 of the steam conduit 310, the foreign substances are blocked by the bent portion 312 preventing the foreign substances from being drawn any farther.

As illustrated in FIG. 8, the bent portion 312 of the steam conduit may be perpendicularly bent downward or "u" shaped. One of skill in the art will appreciate that bend 312 may be horizontally, spirally, or otherwise bent depending upon design and manufacturing constraints without departing from the scope and spirit of the disclosure.

In the event that foreign substances remain within the steam conduit 310, the foreign substances should be expelled out of the conduit 310. Accordingly, a foreign substance outlet hole 326 may be formed at a second predetermined portion near the output end 311 of the steam conduit 310. Foreign substances may be expelled out of steam conduit 310 through the foreign substance outlet hole 326. The foreign substance outlet hole 326 communicates with the inside of the washing tub 18. Consequently, any expelled foreign substances may be collected in washing tub 18. More specifically, foreign substances may be drawn through the end of the steam conduit 310 and expelled into washing tub 18 via foreign substance outlet hole 326.

Further, as illustrated in FIG. 8, a foreign substance prevention partition 328 may be provided at a third predetermined portion near the output end 311 of the steam conduit 310 to prevent the foreign substances from being drawn into the steam conduit 310 farther. Foreign substance prevention partition 328 may act to subdivide a portion of steam conduit 310 near the output end 311 thereof. During operation of the washing machine, the foreign substances are stopped by the foreign substance prevention partition 328.

Further, foreign substance prevention partition 328 has the effect of enhancing steam pressure within steam conduit 310, as well as preventing the foreign substances from being drawn farther therein. Additionally, the foreign substance prevention partition 328 functions to guide the foreign substances toward the foreign substance outlet hole 326. The foreign substance outlet hole 326 and the foreign substance prevention partition 328 may be disposed closer to the output end 311 of the steam conduit 310 than the bent portion 312.

One of skill in the art will appreciate that the above structures, i.e., the bent steam conduit 310, the foreign substance outlet hole 326, or the foreign substance prevention partition 328, may all be utilized in the dishwasher disclosed herein. Alternatively, at least two of them may be utilized in combination with out departing from the scope of the disclosure.

The dishwasher according to the embodiments has the following advantageous effects. Steam is supplied to the washing tub and thus the foreign substances adhering to the dishes may be removed completely and efficiently. Furthermore, the inlet hole and the outlet hole are not positioned in parallel. Accordingly, even if the foreign substances are drawn through the outlet hole, the foreign substances may not be directly drawn into the steam conduit but may remain inside the nozzle part. Thus, the foreign substances may be prevented from being drawn into the steam conduit or any farther.

A still further advantage is that the foreign substance outlet hole is formed such that the foreign substances drawn into the nozzle part or the steam conduit may be expelled through the foreign substance outlet hole. As a result, the foreign substances are prevented from accumulating or spoiling inside the nozzle part or the steam conduit.

A still further advantage is that the foreign substance prevention partition is formed such that the foreign substances are prevented from being drawn-in farther. In addition, the foreign substance prevention partition guides the foreign substances toward the foreign substance outlet hole and enhances the steam pressure.

A still further advantage is that the water condensed from the steam may be also prevented from being drawn into the steam conduit or may be collected in the washing tub. As a result, the condensation of steam may be reduced, which will enhance dishwashing efficiency.

It will be apparent to those skilled in the art that various modifications and variations can be made. Thus, it is intended that the claims cover these modifications and variations.

What is claimed is:

1. A dishwasher comprising:

a washing tub;

a steam generator for generating steam; and a steam conduit connected to said steam generator and said washing tub, said steam conduit comprising an output end proximately located to said washing tub, wherein the conduit includes a bend adjacent the output end configured for preventing foreign substances from flowing into the steam generator, wherein said output end of said steam conduit further comprises a foreign substance prevention partition configured to direct foreign substances towards a foreign substance outlet hole.

2. The dishwasher of claim 1, wherein said output end of the steam conduit comprises the foreign substance outlet hole configured to exhaust foreign substances from within said output end of the steam conduit.

3. The dishwasher of claim 1, wherein said foreign substance prevention partition is configured to prevent foreign substances from moving further into the steam conduit.

4. The dishwasher of claim 1, wherein said foreign substance prevention partition is configured to enhance steam pressure within the steam conduit.

5. The dishwasher of claim 1, wherein said foreign substance prevention partition is positioned between the foreign substance outlet hole and the bent portion of said output end.

6. The dishwasher of claim 1, wherein the bend is "u" shaped.

* * * * *